United States Patent [19]

Nakaniwa et al.

[11] Patent Number: 4,947,816

[45] Date of Patent: Aug. 14, 1990

[54] CONTROL SYSTEM FOR INTERNAL COMBUSTION ENGINE WITH IMPROVED CONTROL CHARACTERISTICS AT TRANSITION OF ENGINE DRIVING CONDITION

[75] Inventors: Shinpei Nakaniwa; Naoki Tomisawa, both of Isezaki, Japan

[73] Assignee: Japan Electronic Control Systems Company, Limited, Isezaki, Japan

[21] Appl. No.: 261,887

[22] Filed: Oct. 25, 1988

[30] Foreign Application Priority Data

Oct. 27, 1987 [JP] Japan ..... 62-269467

[51] Int. Cl.[5] ..... F02D 41/10; F02P 5/15

[52] U.S. Cl. ..... 123/422; 123/478; 123/492

[58] Field of Search ..... 123/478, 480, 486, 488, 123/492, 493, 494, 489, 417, 422, 423

[56] References Cited

U.S. PATENT DOCUMENTS

| | | | |
|---|---|---|---|
| 4,442,812 | 4/1984 | Mizuno et al. | 123/480 X |
| 4,463,732 | 8/1984 | Isobe et al. | 123/492 |
| 4,548,178 | 10/1985 | Sato et al. | 123/478 |
| 4,549,516 | 10/1985 | Koumura | 123/478 |
| 4,573,443 | 3/1986 | Watanabe et al. | 123/492 |

FOREIGN PATENT DOCUMENTS

| | | |
|---|---|---|
| 57-65835 | 4/1982 | Japan . |
| 59-145364 | 8/1984 | Japan . |
| 59-162334 | 9/1984 | Japan . |
| 60-35145 | 2/1985 | Japan . |
| 60-35158 | 2/1985 | Japan . |
| 60-122241 | 6/1985 | Japan . |
| 60-201035 | 10/1985 | Japan . |
| 61-25942 | 2/1986 | Japan . |

*Primary Examiner*—Tony M. Argenbright

*Attorney, Agent, or Firm*—Foley, Lardner, Schwartz, Mack, Blumenthal & Evans

[57] ABSTRACT

An engine control system introduces a technology of assuming actually required fuel amount to be delivered to each engine cylinder at opening timing of an intake valve of the engine cylinder. In order to derive the assumed fuel demand, a basic fuel supply amount is derived on the basis of a basic fuel supply control parameter including an engine speed data and an intake air amount representative data, an air induction path area variation ratio data and a lag time data from derivation of the air induction path area variation ratio data to opening of the intake valve. The assumed fuel demand data can be used not only for controlling fuel supply but also for spark ignition timing control, air/fuel ratio control and so forth so that the engine operation control may precisely follow the actual engine driving condition for optimizing the engine performance.

13 Claims, 12 Drawing Sheets

ROM
ATH
DB
AISC
NVO
KTA
PBD
KFLAT
KALT
CPU
FL FEEDBACK
FL LEAN
FL RICH
FL INV
FL ABNORMAL
FLACC
TACC
FALT
FL EV
FLTRS
FLUP
ALT
T
C
RAM
TVO
KλI
KLRN
ALTO
I
INTERFACE
A/D
N
Ti
Ta
TVO
SIDL
VPB
Tw
O2
θ ref
θ pos
VSP
NT
SCINJ
SC IDL
INTAKE AIR TEMP.
THROTTLE ANGLE
IDLING
INTAKE AIR PRES.
COOLANT TEMP.
O2
CRANK ANGLE
VEHICLE SPEED
NEUTRAL
INJECTION
IDLING SPEED

CONTROL SYSTEM FOR INTERNAL COMBUSTION ENGINE WITH IMPROVED CONTROL CHARACTERISTICS AT TRANSITION OF ENGINE DRIVING CONDITION

BACKGROUND OF THE INVENTION

1. Field of the Invention

The present invention relates generally to a system for controlling operation of an internal combustion engine, such as fuel supply amount, spark ignition timing and so forth. More specifically, the invention relates to an engine control system which can provide an improved control characteristics at a transition state of an engine driving condition.

2. Description of the Background Art

It is conventionally known typical engine control to monitor an intake air related parameter representative of an intake air amount and an engine speed releted parameter representative of an engine revolution speed. Based on the intake air related parameter and the engine speed related parameter, a basic fuel supply amount $T_p$ is derived. The basic fuel supply amount $T_p$ is corrected by a correction value which is derived on the basis of various correction parameters, such as an engine coolant temperature and so forth. The corrected value is output as a final fuel supply data Ti. On the other hand, a spark ignition timing id determined on the basis of the basic fuel supply amount $T_p$ and the engine speed.

In order to monitor the intake air related parameter, an air flow meter or an intake air pressure sensor has been used. Because of lag of such air flow meter or intake air pressure sensor, the intake air related parameter varies to increase and decrease following to actual variation of the intakle air flow amount with a certain lag time. In case of acceleration, such lag of response in variation of the intake air related parameter results in leaner mixture to raise emission problem by increasing of amount of $NO_x$ and HC. Furthermore, due to lag in variation of average effective pressure, acceleration shock and degradation of engine acceleration characteristics can be caused. In addition, since the fuel supply amount becomes smaller than that required. spark advance tends to be excessively advanced to cause engine knocking.

In order to improve such drawback caused by lag of the air flow meter or the intake air pressure sensor, Japanese Patent First (unexamined) Publication (Tokkai) Showa No. 60-201035 discloses a technique for correcting the intake air flow rate measured by the air flow meter or the intake air pressure measured by the intake air pressure sensor according to a variation ratio of a throttle valve open angle in order to derive an assumed intake air flow rate or an assumed intake air pressure. In such system, since the fuel supply amount is derived on the basis of the corrected intake air related parameter, i.e. intake air flow rate or intake air pressure, fluctuation of air/fuel ratio can be minimized for better transition characteristics.

However, because the intake air flow rate and the intake air pressure do not correspond linearly to the throttle valve open angle, expensive work has been required for determining correction values for respective throttle valve angular positions. By extensive work for setting the correction values, cost for the control unit becomes high. Furthermore, though the proposal in the aforementioned Japanese Patent First Publication No. 60-201035 improves response characteristics, it cannot achieve satisfactorily high precision level because the disclosed system does not concern about difference of timing between a timing of measurement of the intake air flow rate or the intake air pressure and a timing of variation of the throttle valve angular position.

SUMMARY OF THE INVENTION

Therefore, it is an object of the present invention to provide an engine control system which can achieves satisfactory precision level in engine control with retaining satisfactorily response characteristics.

Another object of the invention is to provide an engine control system, in which an engine control parameter necessary for controlling engine operation, such as spark ignition timing, a fule injection amount, air/fuel ratio and so forth, by assuming engine load on the basis of intake air path area.

According to one aspect of the invention, a control system for an internal combustion engine, comprises:

means for monitoring engine driving condition representative parameters including an engine speed representative parameter, an engine load representative parameter and an intake air flow path area representative parameter means for monitoring engine revolution cycle to produce an engine position data representative of stroke position of respective engine cylinder means, periodically operated at a known timing, for intake air flow path area variation data on the basis of said intake air flow path area representative parameter means for deriving time difference data between a timing of derivation of said intake air flow path variation data and open timing of intake valves of respective engine cylinder on the basis of said engine position data and said known timing means for deriving a basic fuel demand for each engine cylinder at an open timing of the associated intake valve on the basis of said engine speed representative data, said engine load representative data, said intake air flow path area variation data and said time difference data and means for controlling engine operation on the basis of said basic fuel demand.

According to another aspect of the invention, a control system for an internal combustion engine, comprises:

means for monitoring engine driving condition representative parameters including an engine speed representative parameter, an engine load representative parameter and an intake air flow path area representative parameter means for monitoring engine revolution cycle to produce an engine position data representative of stroke position of respective engine cylinder means, periodically operated at a known timing, for intake air flow path area variation data on the basis of said intake air flow path area representative parameter means for deriving time difference data between a timing of derivation of said intake air flow path variation data and open timing of intake valves of respective engine cylinder on the basis of said engine position data and said known timing means for deriving an assumed engine load data at engine cylinder at an open timing of the associated intake valve on the basis of said engine speed representative data, said engine load representative data, said intake air flow path area variation data and said time difference data and means for controlling engine operation on the basis of said engine speed representative data and said assumed engine load data.

In both case, the controlling means derives a fuel supply amount for each engine cylinder on the basis of said engine speed data and said assumed engine load data. The controlling means may also derive a spark ignition timing for said internal combustion engine on the a basic fuel supply amount calculated on the basis of said engine speed representative data and said assumed engine load data. The controlling means may further perform an air/fuel ratio control on the basis of said basic fuel supply amount calculated on the basis of said engine speed representative data and said assumed engine load data.

According to a further aspect of the invention, a control system for an internal combustion engine, comprises:

means for monitoring engine driving condition representative parameters including an engine speed representative parameter, an engine load representative parameter and an intake air flow path area representative parameter means for deriving a basic fuel supply amount on the basis of said engine speed representative parameter and said engine load representative parameter means for intake air flow path area variation data on the basis of said intake air flow path area representative parameter means for deriving an iake air flow path variation data on the basis of said intake air flow path area representative parameter means for disctiminating engine operating condition on the basis of said intake air flow path variation data for deriving a correction value for said basic fuel supply amount on the basis of said engine speed representative parameter and said intake air flow path area variation data for increasing and dececreasing fuel supply amount depending on the gradiaent of engine load variation detected from said intake air flow path area variation data and means for correcting said basic fuel supply amount with said correction value for controlling fuel supply to the engine based thereon.

The controlling means may detect an engine acceleration demand based on said intake air flow path area variation data for deriving a temporary fuel supply amount on the basis of said intake air flow path area variation data and said engine speed representative pamater and performing fuel supply irrespective of an engine revolution cycle.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENT

Figure 1:
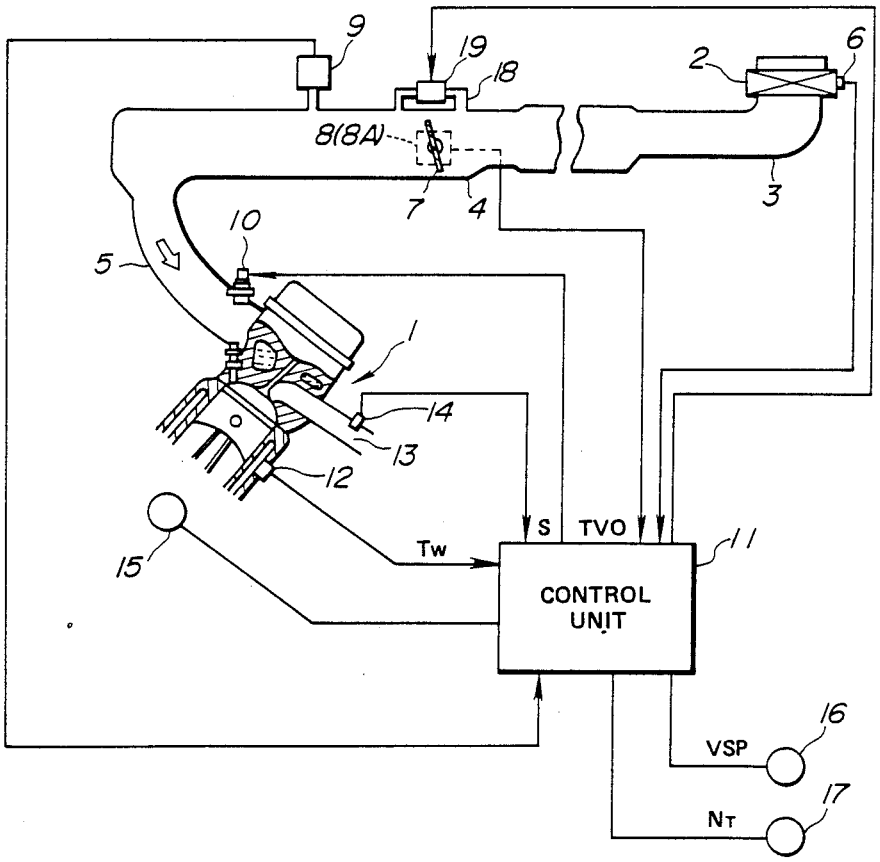
FIG. 1 is a schematic block diagram showing the preferred embodiment of a fuel supply control system according to the present invention.
Figure 2:
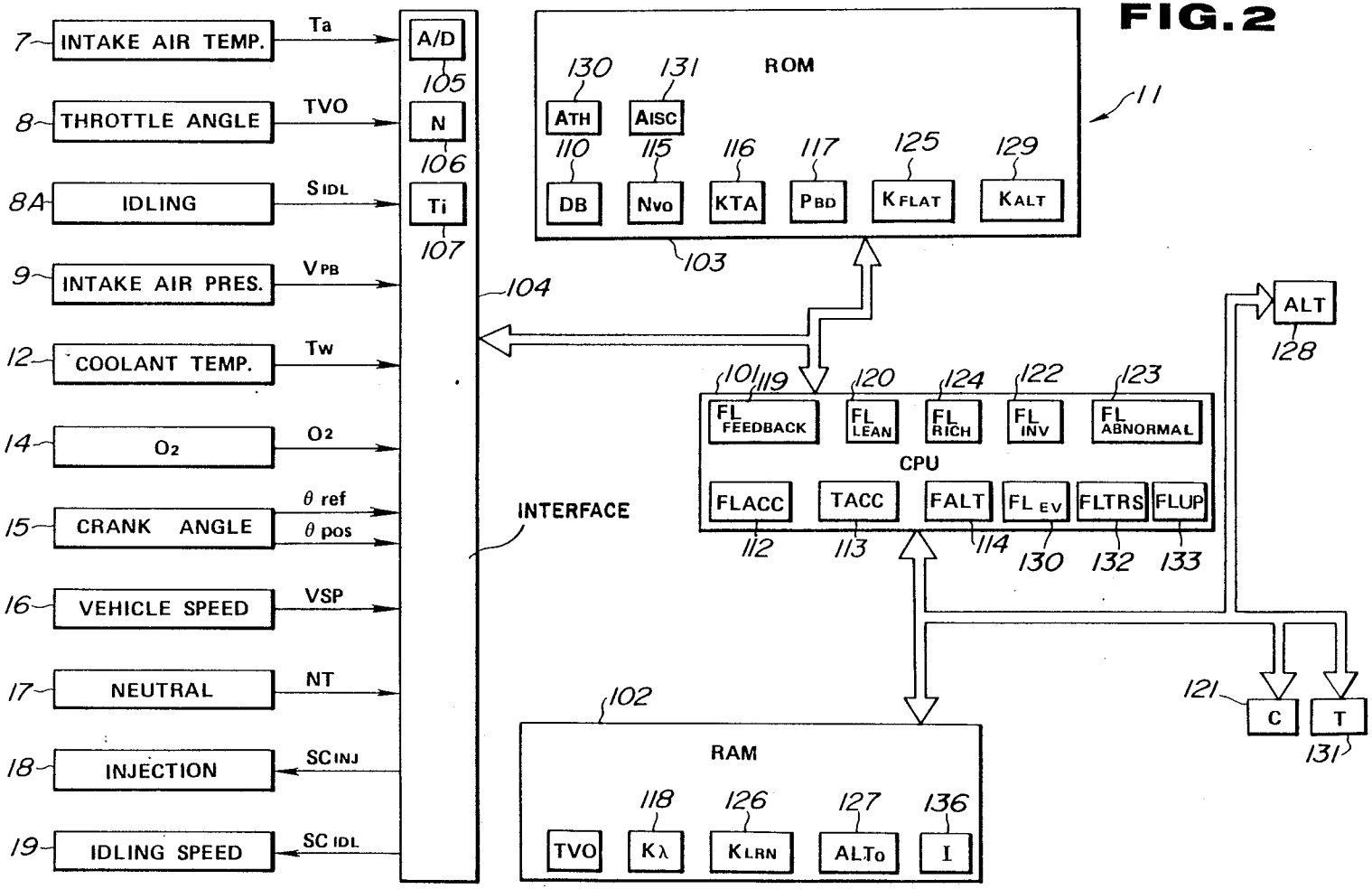
FIG. 2 is a block diagram showing detail a control unit of the preferred embodiment of the fuel supply control system of FIG. 1.

Referring now to the drawings, particularly to FIG. 1, the preferred embodiment of a fuel supply control system, according to the present invention, will be discussed in terms of fuel supply control for a fuel injection internal combustion engine. The fuel injection internal combustion engine 1 has an air induction system including an air cleaner 2, an induction tube 3, a throttle chamber 4 and an intake manifold 5. An intake air temperature sensor 6 is provided in the air cleaner 2 for monitoring temperature of an intake air to produce an intake air temperature indicative signal.

A throttle valve 7 is pivotably disposed within the throttle chamber 4 to adjust an intake air path area according to depression magnitude of an accelerator pedal (not shown). A throttle angle sensor 8 is associated with the throttle valve 7 to monitor the throttle valve angular position to produce a throttle angle indicative signal TVO. The throttle angle sensor 8 incorporates an idling switch 8A which is designed to detect the throttle valve angular position in substantially closed position. In practice, the idling switch 8A is held OFF while throttle valve open angle is greater than a predetermined engine idling criterion and ON while the throttle valve open angle is smaller than or equal to the engine idling criterion. An intake air pressure sensor 9 is provided in the induction tube 3 at the orientation downstream of the throttle valve 7 for monitoring the pressure of the intake air flow through the throttle valve 7 for producing an intake air pressure indicative signal.

In the shown embodiment, a plurality of fuel injection valves (only one is shown) 10 are provided in respective branch paths in the intake manifold 5 for injecting the controlled amount of fuel for respectively associated engine cylinder. Each fuel injection valve 10 is connected to a control unit 11 which comprises a microprocessor. The control unit 11 feeds a fuel injection pulse for each fuel injection valve 10 at a controlled timing in synchronism with the engine revolution cycle to perform fuel injection.

The control unit 11 is also connected to an engine coolant temperature sensor 12 which is inserted into an engine coolant chamber of an engine block to monitor temperature of the engine coolant and produces an engine coolant temperature indicative signal Tw. The control unit 11 is further connected to an oxygen sensor 14 disposed within an exhaust passage 13 of the engine. The oxygen sensor 14 monitors oxygen concentration contained in an exhaust gas flowing through the exhaust passage 13 to produce an oxygen concentration indicative signal. The control unit is additionally connected to a crank angle sensor 15, a vehicle speed sensor 16 and a transmission neutral switch 17. The crank angle sensor 15 monitors angular position of a crank shaft and thus monitors angular position of engine revolution cycle to produce a crank reference signal $\theta_{ref}$ at every predetermined angular position, e.g. at every crankshaft angular position 70° before top-dead center (BTDC), and a crank position signal at every predetermined angle, e.g. 1° of engine revolution. The transmission neutral switch 17 detects setting of neutral position of a power transmission (not shown) to output transmission neutral position indicative HIGH level signal $N_T$.

Furthermore, the control unit 11 receives the intake air temperature indicative signal from the intake air temperature sensor 6 and throttle angular position indicative signal of the throttle angle sensor 8, the idling switch 8A and the intake air pressure sensor 9.

In the shown embodiment, an auxiliary air passage 18 is provided to the air induction system and by-passes the throttle valve 7 for supplying an auxiliary air. An idling speed adjusting auxiliary air flow control valve 19 is provided in the auxiliary air passage 18. The auxiliary air flow control valve 19 is further connected to the control unit 11 to receive an idling speed control signal which is a pulse train having ON period and OFF period variable depending upon the engine driving condition for adjusting the duty ratio of the open period of the auxiliary air control valve 11. Therefore, by way of this idling speed control signal, the engine idling speed can be controlled.

Generally, the control unit 11 comprises CPU 101, RAM 102, ROM 103 and input/output interface 104. The input/output interface 104 has an analog-to-digital (A/D) converter 105, an engine speed counter 106 and a fuel injection signal output circuit 107. The A/D converter 105 is provided for converting analog form input signals such as the intake air temperature indicative signal Ta from the intake air temperature sensor 6, the engine coolant temperature indicative signal Tw of the engine coolant temperature sensor 12, the oxygen concentration indicative signal $0_2$, a vehicle speed indicative signal VSP of the vehicle speed sensor 16 and so forth. The engine speed counter 106 counts clock pulse for measuring interval of occurrences of the crank reference signal $\theta_{ref}$ to derive an engine speed data N on the basis of the reciprocal of the measured period. The fuel injection signal output circuit 107 includes a temporary register to which a fuel injection pulse width for respective fuel injection valve 10 is set and outputs drive signal for the fuel injection signal at a controlled timing which is derived on the basis of the set fuel injection pulse width and predetermined intake valve open timing.

Detail of the discrete form construction of the control unit will be discussed from time to time with the preferred process of the fuel injection control to be executed by the control unit. which process will be discussed herebelow with reference to FIGS. 3 to 13.

Figure 3:
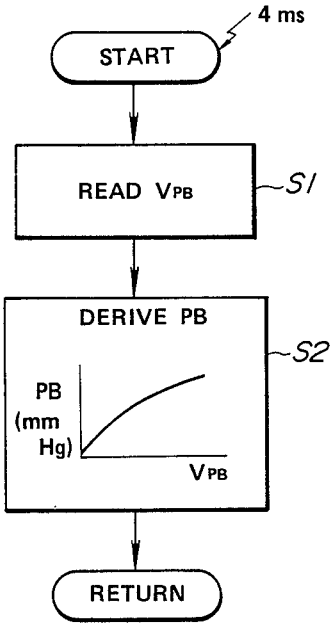
FIG. 3 is a flowchart of a routine for deriving a intake air pressure on the basis of an intake pressure indicative signal of a intake air pressure sensor.

FIG. 3 shows a routine for deriving an intake air pressure data $P_B$ on the basis of the intake air pressure indicative signal $V_{PB}$ which is originally voltage signal variable of the voltage depending upon the magnitude of the intake air pressure. The shown routine of FIG. 3 is triggered and executed every 4 ms by interrupting a background job which may include a routine for governing trigger timing of various interrupt routines, some of which will be discussed later.

Immediately after starting execution of the routine of FIG. 3, the intake air pressure indicative signal $V_{PB}$ is read out at a step S1. Then, a intake air pressure map 110 which is set in ROM 103 in a form of one-dimensional map, is accessed at a step S2. At the step S2, map look-up is performed in terms of the read intake air pressure indicative signal $V_{PB}$ to derive the intake air pressure data PB. After deriving the intake pressure data PB (mmHg), process returns to the background job.

Figure 4A:
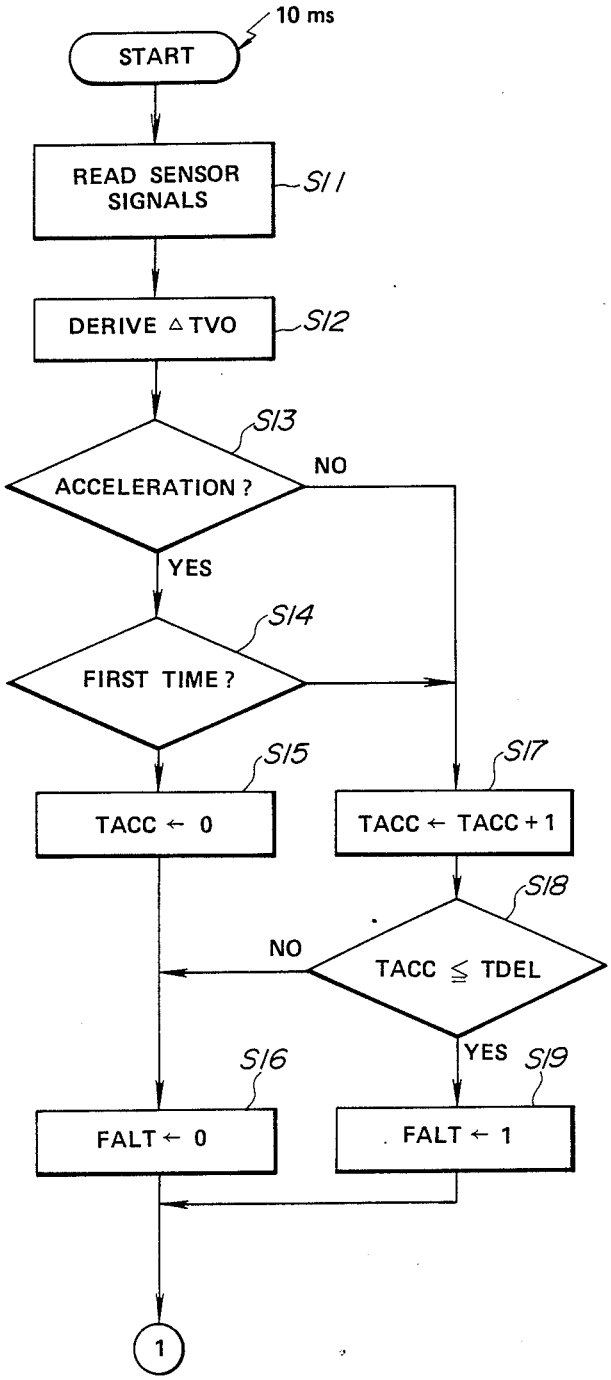
FIGS. 4(*a*), 4(*b*) and 4(*c*) are flowcharts showing a sequence of an interrupt routine for deriving a fuel injection amount.
Figure 4B:
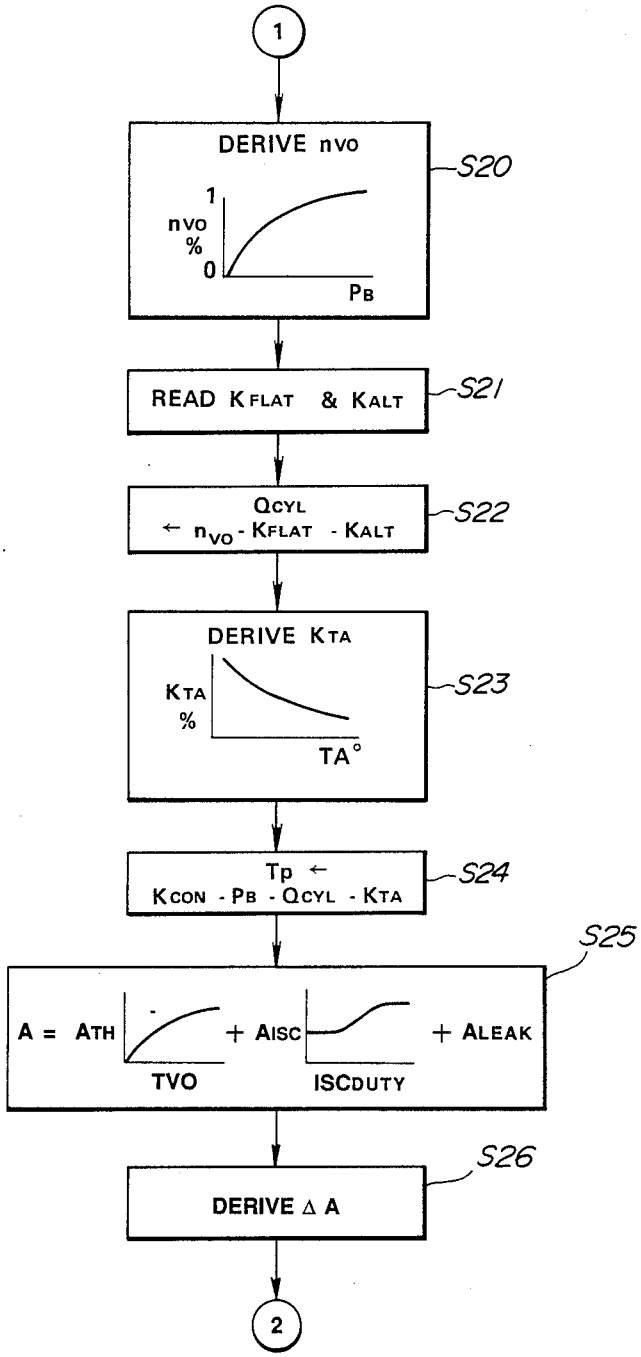
Figure 4:
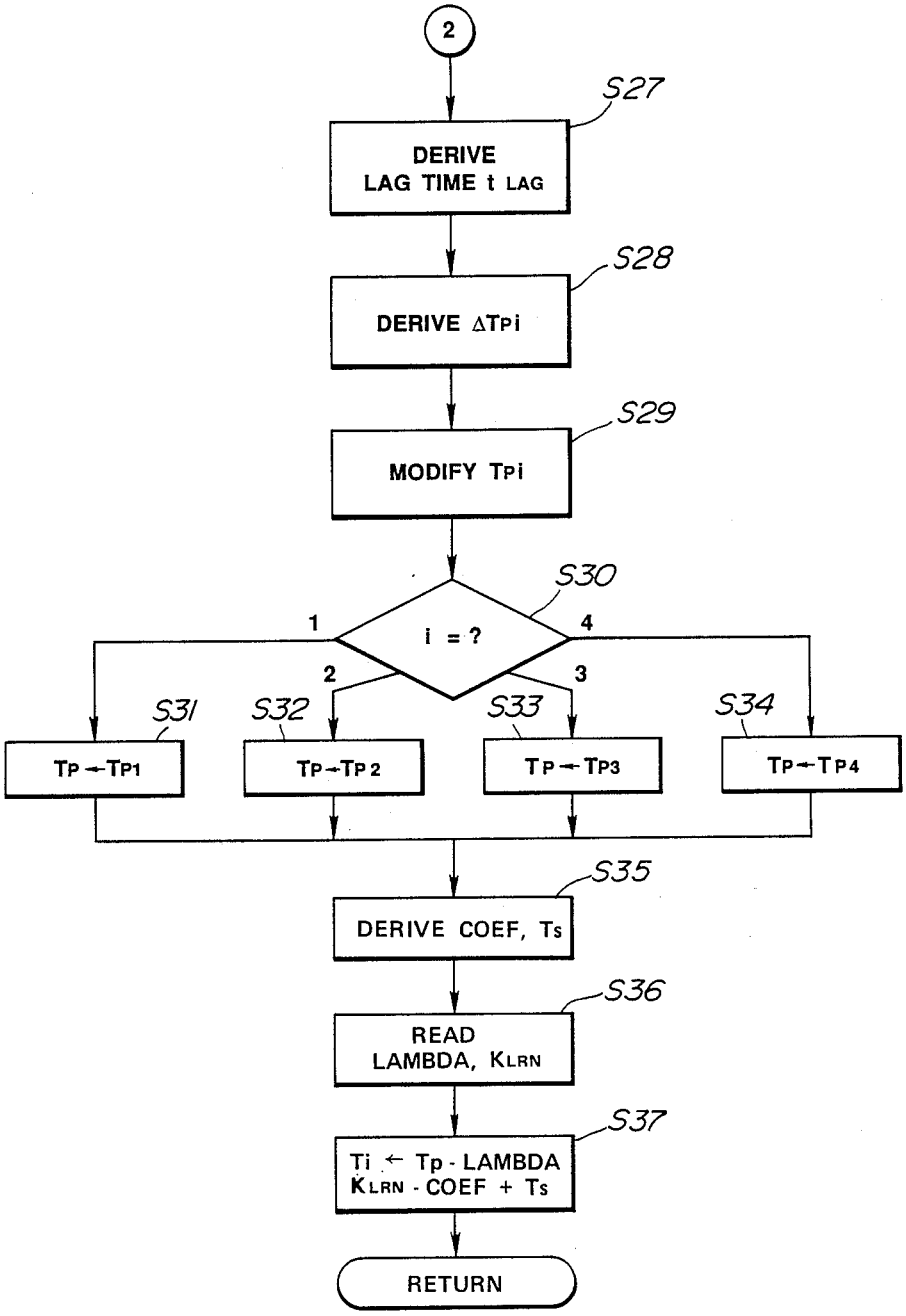

FIGS. 4(A) and 4(B) show a sequence of fuel injection amount Ti derivation routine which is executed at every 10 ms. Immediately after starting execution, input sensor signals including the throttle angle indicative signal TVO are read out at a step S11. At the step S11, the intake air pressure data PB which is derived through the routine of FIG. 3 is also read out. At at step S12, a throttle valve angular displacement rate ΔTVO is derived. In practice, the throttle valve angular displacement rate ΔTVO is derived by comparing the throttle angle indicative signal value TVO read in the step S11 with the throttle angle indicative signal value read in the immediately preceding execution cycle. For this purpose, RAM 102 is provided a memory address 111 for storing the throttle angle indicative signal value TVO to be used in derivation of the throttle valve angular displacement rate ΔTVO in the next execution cycle. Therefore, at the end of process in the step S12, the content of the TVO storing memory address 111 is updated by the throttle valve indicative signal value read at the step S11. Then, the throttle valve displacement rate ΔTVO is compared with an acceleration threshold and a deceleration threshold to check whether acceleration or deceleration of the engine is demanded or not, at a step S13.

When the throttle angle displacement rate ΔTVO is greater than or equal to the acceleration threshold or smaller than the deceleration threshold as checked at the step S13, further check is performed at a step S14, whether the current cycle is the first cycle in which the acceleration demand or deceleration is detected. For enabling this judgement, a flag FLACC is set in a flag register 112 in CPU 101 when acceleration or deceleration demand is at first detected. Though there is no illustrated routine of resetting the FLACC flag in the flag register 112, it may be preferable to reset the FLACC flag after a given period of termination of the acceleration or deceleration demand.

When the first occurrence of acceleration or deceleration demand is detected at the step S15, a timer 113 for measuring a period of time, in which acceleration or deceleration demand is maintained, is reset to clear a timer value TACC to zero (0). After the step S14, a flag FALT in a flag register 114 which is indicative of enabling state of learning of assuming of altitude depending upon the engine driving condition while it is set and indicative of inhibited state of learning while it is reset, is reset at a step S16.

On the other hand, when the acceleration or deceleration demand is not detected as checked at the step S13 or when the FLACC flag of the FLACC flag register is set as checked at the step S14, the timer value TACC of the TACC timer 113 is incremented by 1, at a step S17. Thereafter, the timer value TACC is compared with a delay time indicative reference value TDEL which represents lag time between injection timing of the fuel and delivery timing of the fuel to the engine cylinder, at a step S18. Consequently, the time indicative reference value TDEL is variable depending upon the atomization characteristics of the fuel. When the timer value TACC is greater than the time indicative reference value TDEL, process goes to the step S16. On the other hand, when the timer value TACC is smaller than or equal to the time indicative reference value, the FALT flag is set at a step S19.

Figure 10:
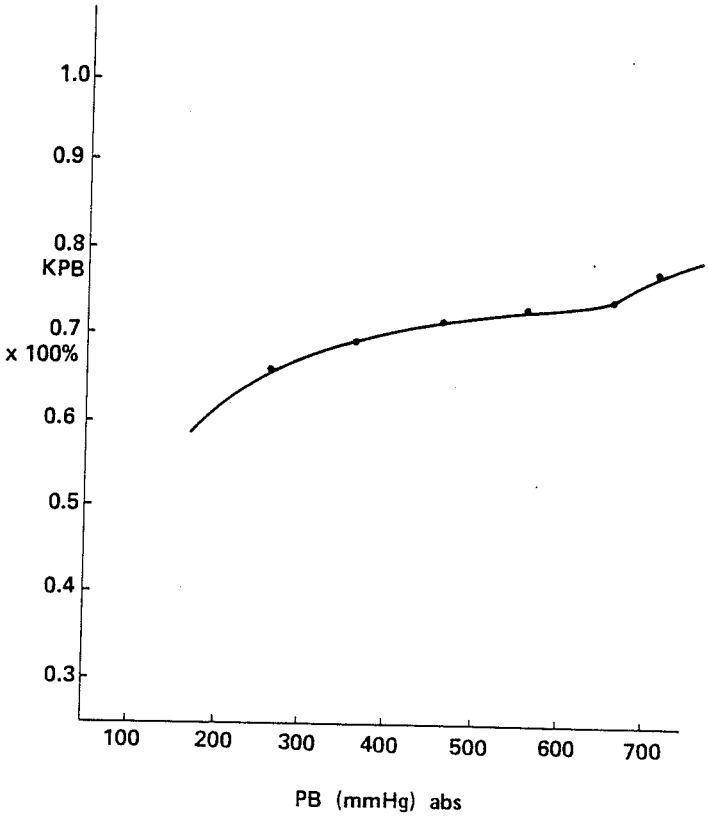
FIG. 10 is a graph showing basic induction volume efficiency versus an intake air pressure, experimentally obtained.

After one of the steps S16 and S19, process goes to a step S20 of FIG. 4(B). At the step S20, a basic induction volumetric efficiency $n_{vo}$ (%) is derived in terms of the intake air pressure data PB. The experimentally derived relationship between the intake air pressure PB and and the induction volumetric efficiency $n_{vo}$ is shown in FIG. 10. In order to derive the basic induction volumetric efficiency $n_{vo}$, one-dimensional table is set in a memory block 115 of ROM 103, which memory block will be hereafter referred to as $n_{vo}$ map . At a step S21, an engine condition dependent volumetric efficiency correction coefficient $K_{FLAT}$ which will be hereafter referred to as $K_{FLAT}$ correction coefficient , and altitude dependent correction coefficient $K_{ALT}$ which will be hereafter referred to as $K_{ALT}$ correction coefficient are read out. Then, at a step S22, an induction volumetric efficiency $Q_{CYL}$ is derived by the following equation:

$$QCYL = n_{vo} \times K_{FLAT} \times K_{ALT}$$

After the step S22, in which the induction volume efficiency $Q_{CYL}$ is derived, the intake air temperature signal value Ta is read at a step S23. At the step S23, it is also performed to derive an intake air temperature dependent correction coefficient $K_{TA}$, which will be hereafter referred to as $K_{TA}$ correction coefficient. Practically, in order to enable derivation of the intake air temperature dependent is performed by map look us against a memory address 116 of ROM 103, in which map of the intake air temperature dependent correction coefficient $K_{TA}$ is set in terms of the intake air temperature Ta.

A basic fuel injection amount Tp is derived at a step S24 according to the following equation:

$$Tp = K_{con} \times PB \times Q_{CYL} \times K_{TA}$$

Figure 5:
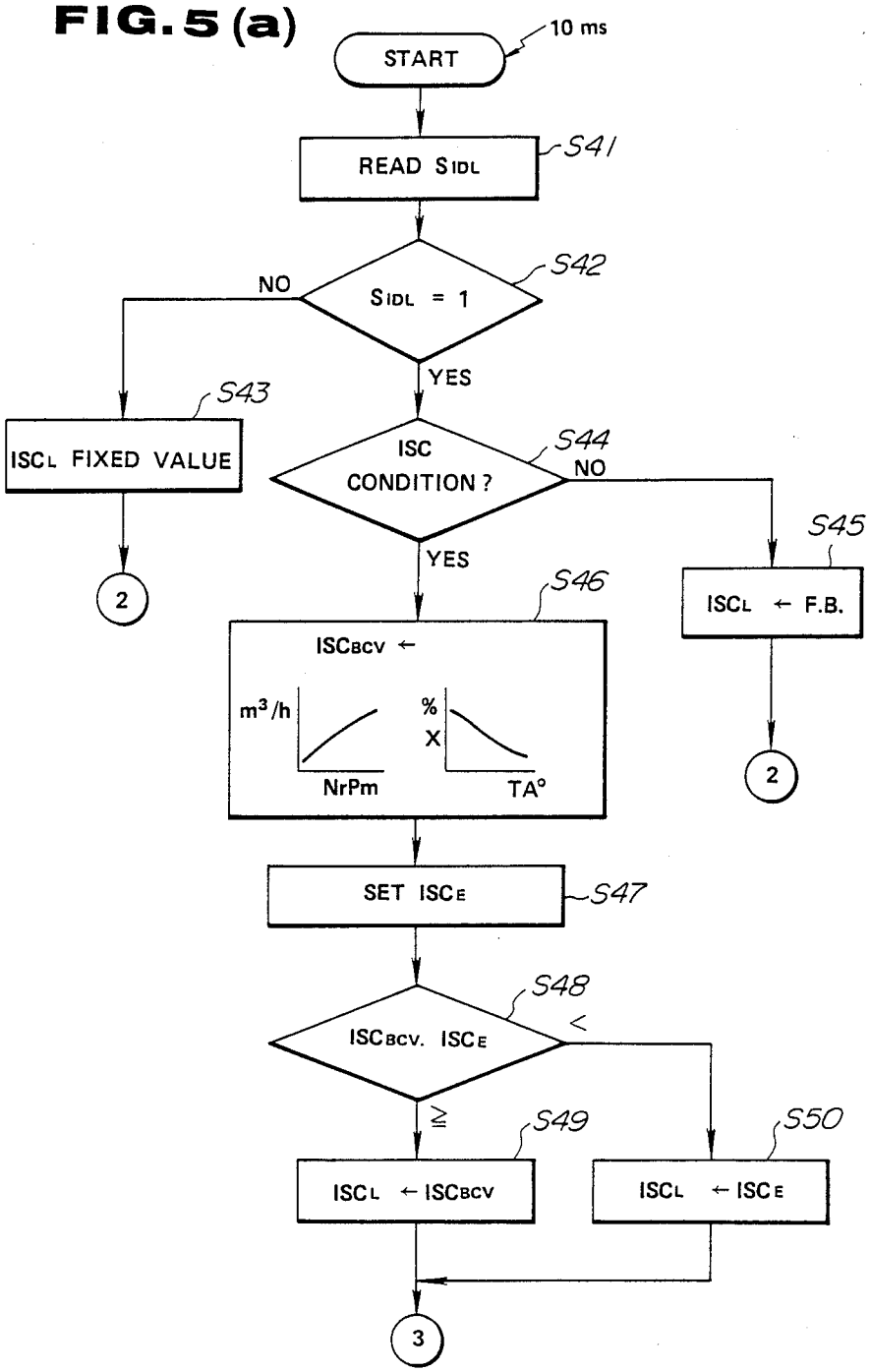
FIGS. 5(*a*) and 5(*b*) are flowcharts showing a sequence of interrupt routine for setting an engine idling controlling duty ratio and assuming an altitude for altitude dependent fuel supply amount correction.
Figure 5:
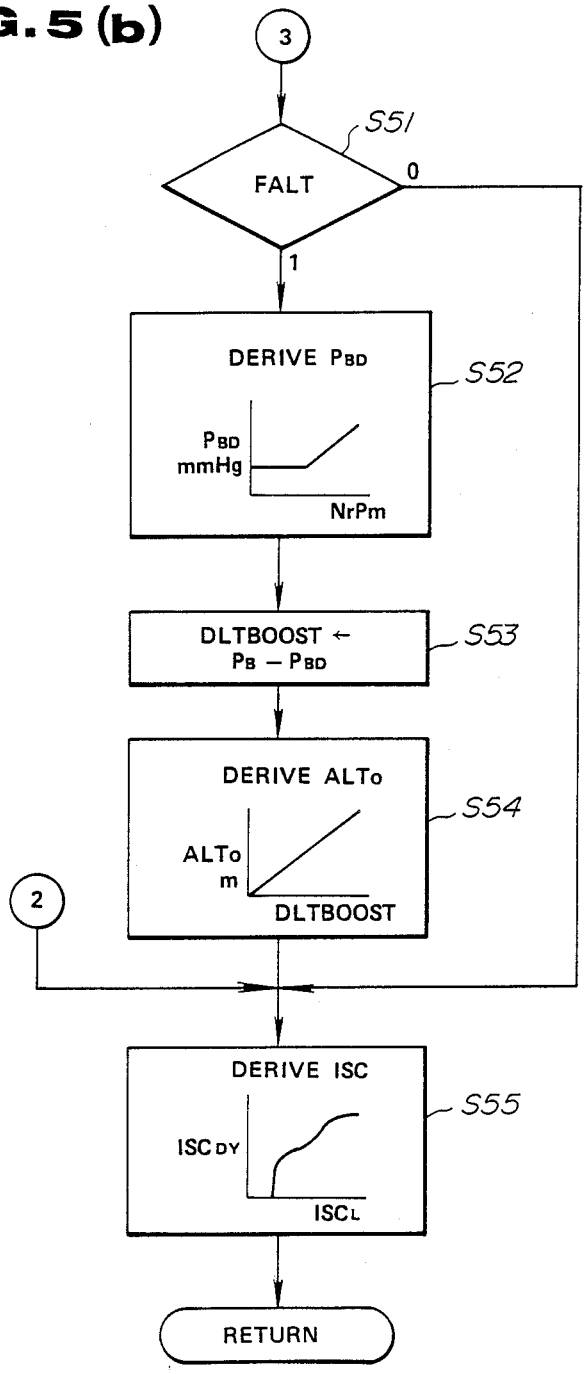

At a step S25, an air intake path area A is derived on the basis of the throttle valve angular position represented by the throttle angle indicative signal TVO and an auxiliary air control pulse width $ISC_{DY}$ which is determined through an engine idling speed control routine illustrated in FIGS. 5(*a*) and 5(*b*). In practice, the intake air flow path area $A_{TH}$ is derived through map look up by looking a primary path area map set in a memory block 130 in ROM 103 in terms of the throttle valve angular position TVO. Similarly, the auxiliary intake air flow path area $A_{ISC}$ is derived through map look-up by looking up an auxiliary air flow path map set in a memory block 131 of ROM 103 in terms of the duty cycle $ISC_{DY}$ of the auxiliary air control pulse. Respective primary path area map and the auxiliary intake air flow path map are set to vary the value according to variation of the throttle valve angular position TVO and the auxiliaty air control pulse duty cycle $ISC_{DY}$ as shown in block of the step S25. In the practical process of derivation of the intake air path area A at the step S25, a a value $A_{LEAK}$ set in view of an amount of air leaking through a throtle adjusting screw, an air regulator and so forth. Therefore, the intake air path area A can be practically derived by the following equaition:

$$A = {}_{th} + A_{ISC} + A_{LEAK}$$

Figure 11:
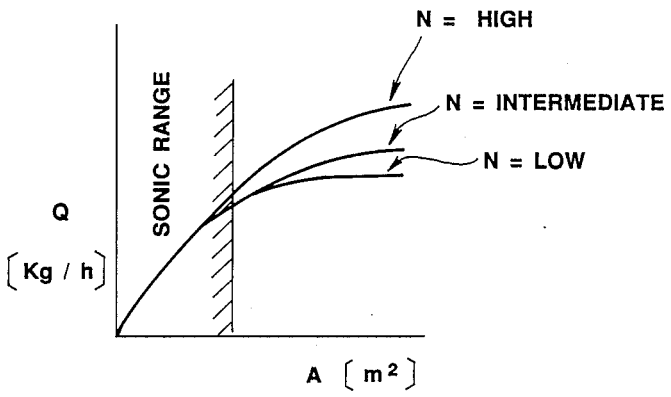
FIG. 11 is a graph showing variation of an intake air flow rate (Q) in relation to an intake air path area (A)
Figure 12:
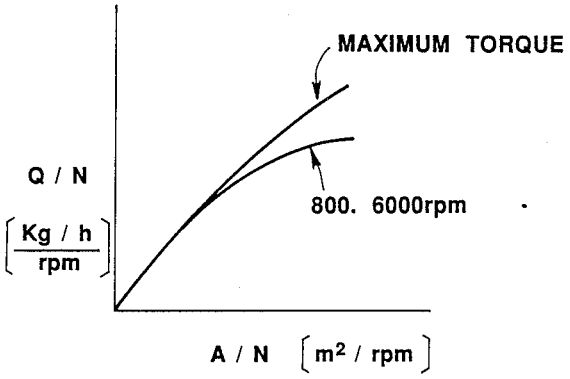
FIG. 12 is a graph showing a basic engine load (Q/N) in relation to a ratio of intake air path area (A) versus an engine speed (N)

At a step S26, a variation ratio ΔA of the intake air path area A in a unit time, e.g. within an interval of execution cycles, is derived. Thereafore, a lag time $t_{LAG}$ from the time of derivation of the intake air path area variation ratio ΔA to the opening time of respective intake valves of the engine cylinders is determined. Practically, the crank angle position at the time of derivation of the intake air path area variation ratio ΔA is detected and compared with preset intake valve opening time of a respective intake valve. Therefore, the lag time $t_{LAG}$ as derived is represented by a difference $\leftarrow\theta$ of the crank shaft angular position from the angular position at which the intake air path area variation ratio is derived to the crank shaft angular positions at which respective intake valve opens. Therefore, the lag time $t_{LAG}$ is derived as $\Delta\theta/N$. Then, correction value ΔTpi (i is a sign showing number of engine cylinder and therefore vaires 1 through 4, in case of the 4-cylinder engine) of the basic fuel injection amount Tp for each cylinder is derived by:

$$\Delta Tpi = \Delta A/N \times t_{LAG} \times K$$

where K is a constant set at a value proportional to Tp×N/Q (Q: intake air flow rate) and ΔA is a variation rate of intake air path area A within a unit time (interval between execution cycle) at a step S28. Here, a relationship between the intake air path area A and the intake air flow rate Q can be illustrated as shown in FIGS. 11 and 12. As seen from FIG. 12, over the engine speed range between 800 rpm to 6000 rpm, relationship between Q/N and A/Q are maintained to vary substantially linearly proportional to each other. Particularly, at the torque peak, the lineality of the relationship between the Q/N and A/N is clear. Therefore, the intake air flow rate variation ΔQ from derivation timing of the intake air path variation ratio ΔA to the intake value open timing substantially correspond to $\Delta A/N \times t_{LAG}$. Therefore, the correction value ΔTpi derived by the foregoing equation substantially corresponds to variation of fuel demand at a respective engine cylinder.

Based on the correction value ΔTpi derived at the step S28, the basic fuel injection amount Tpi for respective engine cylinder is derived by:

$$Tpi = Tp + \Delta Tpi$$

Then, at a step S30, crank shaft angular position $\theta$ is checked to detect the cylinder number i utilizing the crank reference signal $\theta_{ref}$ to which the fuel is to be supplied. Based on the result at the step S30, one of the steps S31 to S34 is selected to set the basic fuel injection amount Tp by the corrected value Tpi at the step S29. At a step S35, a correction coefficient COEF which includes an acceleration enrichment correction coefficient, a cold engine enrichment correction coefficient and so forth as components, and a battery voltage compensating correction value Ts are derived. Derivation of the correction coefficient COEF is performed in per se well known manner which does not require further discussion. At a step S36, an air/fuel ratio dependent feedback correction coefficient $K_\lambda$ which will be hereafter referred to as $K_\lambda$ correction coefficient, and a learning correction coefficient $K_{LRN}$ which is derived through learning process discussed later and will be hereafter referred to as $K_{LRN}$ correction coefficient are read out. Then, at a step S37, the fuel injection amount Ti is derived according to the following equation:

$$Ti = Tp \times K_{80} \times K_{LRN} \times COEF + Ts$$

The control unit 11 derives a fuel injection pulse having a pulse width corresponding to the fuel injection amount Ti and set the fuel injection pulse in the temporary register in the fuel injection signal output circuit 107.

The basic fuel injection amount Tp thus corrected through the routine set forth above, can be utilized for deriving a spark ignition timing. Since the fuel injection amount derived through the foregoing routine is precisely correspond to the instantaneous engine demand, precise spark ignition timing control becomes possible. Particularly, Utilizing the fuel injection amount Tp thus derived allows substantially precise spark ignition timing control at the engine transition state and is effective for suppression of the engine knocking.

FIGS. 5(A) and 5(B) show a sequence of routine for deriving an idling speed control pulse signal and assuming altitude. The shown routine in FIGS. 5(A) and 5(B) is performed at every 10 ms. The trigger timing of this routine is shifted in phase at 5 ms relative to the routine of FIGS. 4(A) and 4(B) and therefore will not interfere to each other.

Immediately after starting execution, a signal level of the idle switch signal $S_{IDL}$ from the idle switch 8a is read at a step S41. Then, the idle switch signal level $S_{IDL}$ is checked whether it is one (1) representing the engine idling condition or not, at a step S42. When the idle switch signal level $S_{IDL}$ is zero (0) as checked at the step S42 and thus indicate that the engine is not in idling condition, an auxiliary air flow rate $ISC_L$ is set at a given fixed value which is derived on the basis of the predetermined auxiliary air control parameter, such as the engine coolant temperature Tw, at a step S43. On the other hand, when the idle switch signal level $S_{IDL}$ is one as checked at the step S42 and thus represents the engine idling condition, the engine driving condition is checked at a step S44 whether a predetermined FEEDBACK control condition which will be hereafter referred to as ISC condition , is satisfied or not. In the shown embodiment, the engine speed data N, the vehicle speed data VSP and the HIGH level transmission neutral switch signal $N_T$ are selected as ISC condition determining parameter. Namely, ISC condition is satisfied when the engine speed data N is smaller than or equal to an idling speed criterion, the vehicle speed data VSP is smaller than a low vehicle speed critrion, e.g. 8 km/h, and the transmission neutral switch signal level is HIGH.

When ISC condition is not satisfied as checked at the step S44, the auxiliary air flow control signal $ISC_L$ is set at a feedback control value F.B. which is derived to reduce a difference between the actual engine speed and a target engine speed which is derived on the basis of the engine coolant temperature, at a step S45. On the other hand, when the ISC condition is satisfied as checked at the step S44, a boost controlling auxiliary air flow rate $ISC_{BCV}$ is set at a value determined on the basis of the engine speed indicative data N and the intake air temperature Ta for performing boost control to maintain the vacuum pressure in the intake manifold constant, at a step S46. As seen in the block of the step S46 in FIG. 5(A), the auxiliary air flow rate ($m^3/h$) is basically determined based on the engine speed indicative data N and is corrected by a correction coefficient (%) derived on the basis of the intake air temperature Ta.

At a step S47, an stable engine auxiliary air flow rate $ISC_E$ is derived at a value which can prevent the engine from falling into stall condition and can maintain the stable engine condition. Then, the stable engine auxiliary air flow rate $ISC_E$ is compared with the boost controlling auxiliary air flow rate $ISC_{BCV}$ at a step S48. When the boost controlling auxiliary air flow rate $ISC_{BCV}$ is greater than or equal to the stable engine auxiliary air flow rate $ISC_E$, the boost controlling auxiliary air flow rate $ISC_{BVC}$ is set as the auxiliary air control signal value $ISC_L$, at a step S49. On the other hand, when the stable engine auxiliary air flow rate $ISC_E$ is greater than the boost controlling auxiliary air flow rate $ISC_{BCV}$, the auxiliary air control signal value $ISC_L$ is set at the value of the stable engine auxiliary air flow rate $ISC_E$ at a step S50.

After one of the step S49 and S50, the FALT flag is checked at a step S51. When the FALT flag is set as checked at the step S51, an intake air pressure $P_{BD}$ during deceleration versus the engine speed indicative data N is derived at a step S52, which intake air pressure will be hereafter referred to as decelerating intake air pressure. In practice, the decelerating intake air pressure $P_{BD}$ is set in one-dimensional map stored in a memory block 117 in ROM 103. The $P_{BD}$ map is looked up in terms of the engine speed indicative data N. Then, a difference of the intake air pressure $P_B$ and the decelerating intake air pressure $P_{BD}$ is derived at a step S53, which difference will be hereafter referred to as pressure difference data ΔBOOST . Utilizing the pressure difference data ΔBOOST derived at the step S53, an assumed altitude data $ALT_O$ (m) is derived. The assumed altitude data $ALT_O$ is set in a form of a map set in a memory block 118 so as to be looked up in terms of the pressure difference data ΔBOOST.

After one of the step S43, S45 and S54 or when the FALT flag is not set as checked at the step S51, an auxiliary air control pulse width $ISC_{DY}$ which defines duty ratio of OPEN period and CLOSE period of the auxiliary air control valve 19, is derived on the basis of the auxiliary air control signal value at a step S55.

Figure 6:
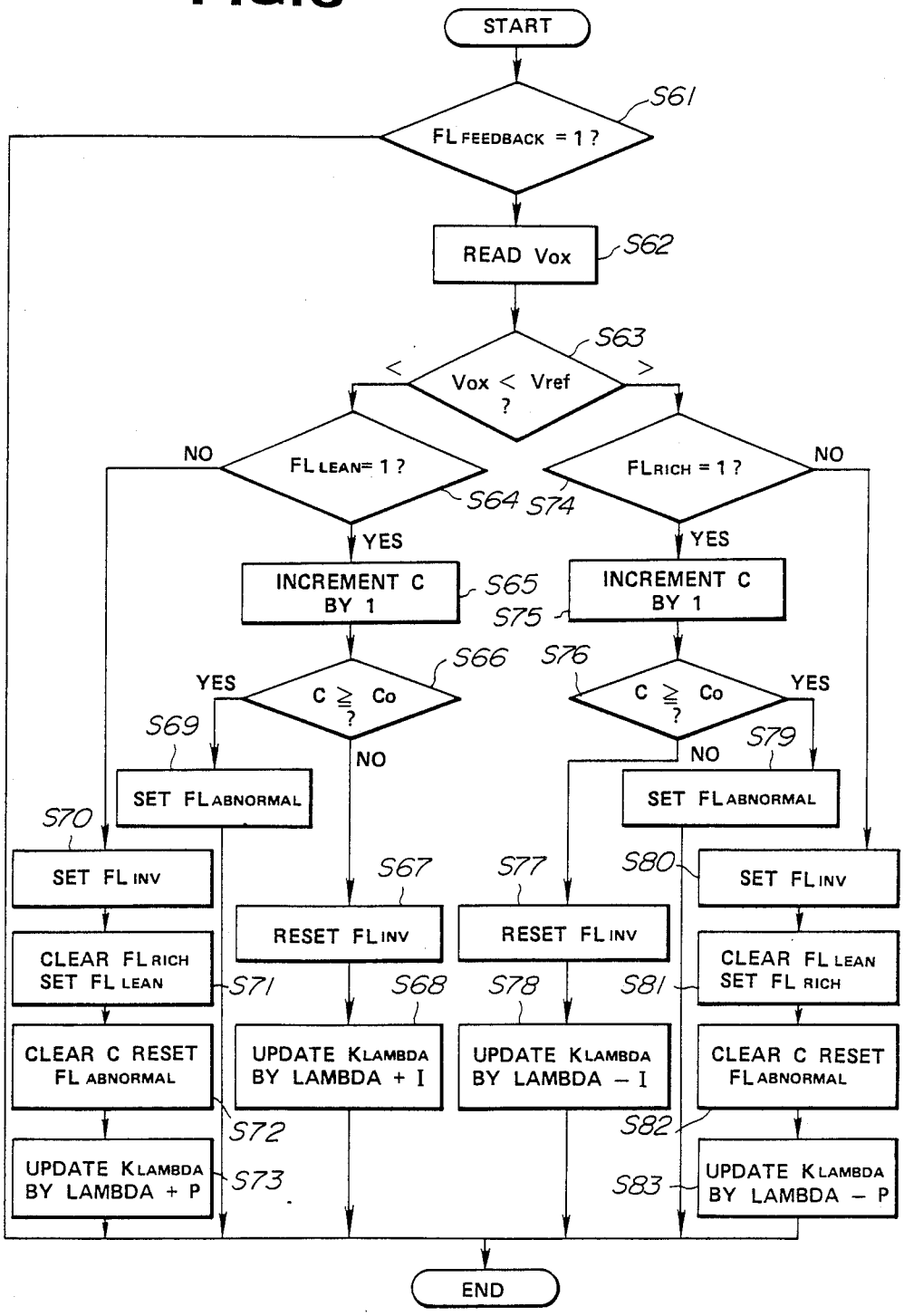
FIG. 6 is a flow chart of an interrupt routine for deriving an air/fuel ratio feedback controlling correction coefficient on the basis of an oxygen concentration in an exhaust gas.
Figure 7:
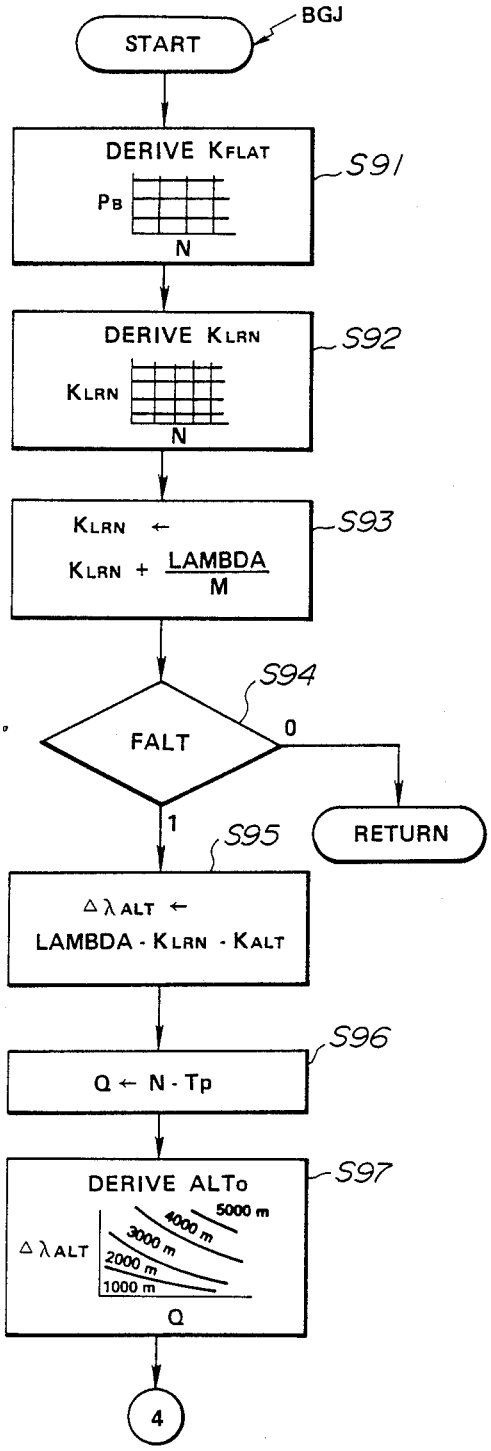
FIGS. 7(*a*) and 7(*b*) are flowcharts showing a sequence of background job executed by the control unit of FIG. 2.
Figure 7:
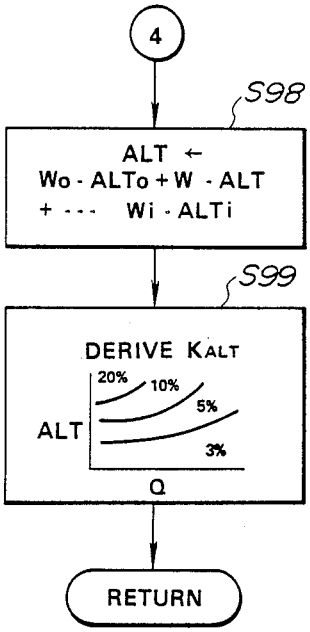

FIG. 6 shows a routine for deriving the feedback correction coefficient $K_\lambda$. The feedback correction coefficient $K_\lambda$ is composed of a proportional (P) component and an integral (I) component. The shown routine is triggered every given timing in order to regularly update the feedback control coefficient $K_\lambda$. In the shown embodiment, the trigger timing of the shown routine is determined in synchronism with the engine revolution cycle. The feedback control coefficient $K_\lambda$ is stored in a memory block 118 and cyclically updated during a period in which FEEDBACK control is performed.

At a step S61, the engine driving condition is checked whether it satisfies a predetermined condition for performing air/fuel ratio dependent feedback control of fuel supply. In practice, a routine (not shown) for governing control mode to switch the mode between FEEDBACK control mode and OPEN LOOP control mode based on the engine driving condition is performed. Basically, FEEDBACK control of air/fuel ratio is taken place while the engine is driven under load load and at low speed and OPEN LOOP control is performed otherwise. In order to selectively perform FEEDBACK control and OPEN LOOP control, the basic fuel injection amount Tp is taken as a parameter for detecting the engine driving condition. For distinguishing the engine driving condition, a map containing FEEDBACK condition indicative criteria $Tp_{ref}$ is set in an appropriate memory block of ROM. The map is designed to be searched in terms of the engine speed N. The FEEDBACK condition indicative criteria set in the map are experimentally obtained and define the engine driving range to perform FEEDBACK control The basic fuel injection amount Tp derived is then compared with the FEEDBACK condition indicative criterion $Tp_{ref}$. When the basic fuel injection amount Tp is smaller than or equal to the FEEDBACK condition indicative criterion $Tp_{ref}$ a delay timer in the control unit and connected to a clock generator, is reset to clear a delay timer value. On the other hand, when the basic fuel injection amount Tp is greater than the FEEDBACK condition indicative criterion $Tp_{ref}$ the delay timer value $t_{DELAY}$ is read and compared with a timer reference value $t_{ref}$. If the delay timer value $t_{DELAY}$ is smaller than or equal to the timer reference value $t_{ref}$, the engine speed data N is read and compared with an engine speed reference $N_{ref}$. The engine speed reference $N_{ref}$ represents the engine speed criterion between high engine speed range and low engine speed range. Practically, the engine speed reference $N_{ref}$ is set at a value corresponding to a high/low engine speed criteria, e.g. 3800 r.p.m. When the engine speed indicative data N is smaller than the engine speed reference $N_{ref}$, or after the step 1106, a FEEDBACK condition indicative flag $FL_{FEEDBACK}$ which is to be set in a flag register 119 in the control unit 100, is set. When the delay timer value $t_{DELAY}$ is greater than The timer reference value $t_{ref}$, a FEEDBACK condition indicative flag $FL_{FEEDBACK}$ is reset.

By providing the delay timer to switch mode of control between FEEDBACK control and OPEN LOOP control, hunting in selection of the control mode can be successfully prevented. Furthermore, by providing the delay timer for delaying switching timing of control mode from FEEDBACK control to OPEN LOOP mode, FEEDBACK control can be maintained for the period of time corresponding to the period defined by the timer reference value. This expands period to perform feedback control and to perform learning.

Therefore, at the step S61, a FEEDBACK condition indicative flag $FL_{FEEDBACK}$ is checked. When the FEEDBACK condition indicative flag $FL_{FEEDBACK}$ is not set as checked at the step S61, which indicates that the on-going control mode is OPEN LOOP. Therefore, process directly goes END. At this occasion, since the feedback correction coefficient $K_\lambda$ is not updated, the content in the memory block 118 storing the feedback correction coefficient is held in unchanged.

When the FEEDBACK condition indicative flag $FL_{FEEDBACK}$ is set as checked at a step S61, the oxygen concentration indicative signal $O_2$ from the oxygen sensor 14 is read out at a step S62. The oxygen concentration indicative signal value $O_2$ is then compared with a predetermined rich/lean criterion $V_{ref}$ which corresponding to the air/fuel ratio of stoichiometric value, at a step S63. In practice, in the process, judgment is made that the air/fuel mixture is lean when the oxygen concentration indicative signal value $O_2$ is smaller than the rich/lean criterion $V_{ref}$, a lean mixture indicative flag $FL_{LEAN}$ which is set in a lean mixture indicative flag register 120 in the control unit 100, is checked at a step S64.

On the other hand, when the lean mixture indicative flag $FL_{LEAN}$ is set as checked at the step S64, a counter value C of a faulty sensor detecting timer 121 in the control unit 100 is incremented by one (1), at a step S65. The counter value C will be hereafter referred to as faulty timer value. The, the faulty timer value C is compared with a preset faulty timer criterion $C_O$ which represents acceptable maximum period of time to maintain lean mixture indicative $O_2$ sensor signal while the oxygen sensor 20 operates in normal state, at a step S66. When the faulty timer value C is smaller than the faulty timer criterion $C_O$, the rich/lean inversion indicative flag $FL_{INV}$ is reset at a step S67. Thereafter, the feedback correction coefficient $K_\lambda$ is updated by adding a given integral constant (I constant), at a step S68. On the other hand, when the faulty timer value C as checked at the step S66 is greater than or equal to the faulty timer criterion $C_O$, a faulty sensor indicative flag $FL_{ABNORMAL}$ is set in a flag register 123 at a step S69. After setting the faulty sensor indicative flag $FL_{ABNORMAL}$ process goes END.

On the other hand, when the lean mixture indicative flag $FL_{LEAN}$ is not set as checked at the step S64, fact of which represents that the air/fuel mixture ratio is adjusted changed from rich to lean, an rich/lean inversion indicative flag $FL_{INV}$ which is set in a flag register 122 in the control unit 100, is set at a step S70. Thereafter, a rich mixture indicative flag $FL_{RICH}$ which is set in a flag register 124, is reset and the lean mixture indicative flag $FL_{LEAN}$ is set, at a step S71. Thereafter, the faulty timer value C in the faulty sensor detecting timer 121 is reset and the faulty sensor indicative flag $FL_{ABNORMAL}$ is reset, at a step S72. Then, the feedback correction coefficient $K_\lambda$ is modified by adding a proportional constant (P constant), at a step S73.

On the other hand, when the oxygen concentration indicative signal value $O_2$ is greater than the rich/lean criterion $V_{ref}$ as checked at the step S63, a rich mixture indicative flag $FL_{RICH}$ which is set in a rich mixture indicative flag register 124 in the control unit 100, is checked at a step S74.

When the rich mixture indicative flag $FL_{RICH}$ is set as checked at the step S74, the counter value C of the faulty sensor detecting timer 121 in the control unit 100 is incremented by one (1), at a step S75. The, the faulty timer value C is compared with the preset faulty timer criterion $C_O$, at a step S76. When the faulty timer value C is smaller than the faulty timer criterion $C_O$, the rich/lean inversion indicative flag $FL_{INV}$ is reset at a step S77. Thereafter, the feedback correction coefficient $K_\lambda$ is updated by subtracting the I constant, at a step S78.

On the other hand, when the faulty timer value C as checked at the step S76 is greater than or equal to the faulty timer criterion $C_O$, a faulty sensor indicative flag $FL_{ABNORMAL}$ is set at a step S79. After setting the faulty sensor indicative flag $FL_{ABNORMAL}$ process goes END.

When the rich mixture indicative flag $FL_{RICH}$ is not set as checked at the step S74, fact of which represents that the air/fuel mixture ratio is just changed from lean to rich, an rich/lean inversion indicative flag $FL_{INV}$ which is set in a flag register 122 in the control unit 100, is set at a step S80. Thereafter, a rich mixture indicative flag $FL_{LEAN}$ is reset and the rich mixture indicative flag $FL_{RICH}$ is set, at a step S81. Thereafter, the faulty timer value C in the faulty sensor detecting timer 121 is reset and the faulty sensor indicative flag $FL_{ABNORMAL}$ is reset, at a step S82. Then, the feedback correction coefficient $K_\lambda$ is modified by subtracting the P constant, at a step S83.

After one of the process of the steps S68, S69, S73, S78, S79 and S83, process goes to the END.

It should be noted that, in the shown embodiment, the P component is set at a value far greater than that of I component.

FIGS. 7(A) and 7(B) show a sequence of a routine composed as a part of the main program to be executed by the control unit 11 as the background job. The shown routine is designed to derive $K_{FLAT}$ correction coefficient, $K_{LRN}$ correction coefficient and altitude dependent correction coefficient, and to derive the assumed altitude.

At a step S91 which is triggered immediately after starting shown routine, $K_{FLAT}$ correction coefficient is derived in terms of the engine speed data N and the intake air pressure data PB for correcting the basic induction volumetric efficiency $n_{vo}$. In practice, the $K_{FLAT}$ correction coefficients are set in a form of two-dimensional look-up table in a memory block 125 of ROM 102. Therefore, the $K_{FLAT}$ correction coefficient is derived through map look up in terms of the engine speed data N and the intake air pressure data PB.

Here, as will be appreciated that magnitude of variation of the induction volumetric efficiency in relation to variation of the engine speed is relative small. Therefore, the $K_{FLAT}$ correction coefficient can be set as a function of the intake air pressure PB. In this case, since the variation range of the $K_{FLAT}$ correction coefficient can be concentrated in the vicinity of one (1). Therefore, number of grid for storing the correction coefficient values for deriving the $K_{FLAT}$ correction coefficient in terms of the engine speed and the intake air pressure can be small. In addition, since delay of updating of the $K_{FLAT}$ correction coefficient cannot cause substantial error, interval of updating of the $K_{FLAT}$ correction coefficient can be set long enough to perform in the background job. Although the updating interval is relatively long, accuracy in derivation of the induction volumetric efficiency can be substantially improved in comparison with the manner of derivation described in the aforementioned Tokkai Showa 58-41230, in which the correction coefficient is derived solely in terms of the engine speed, since the $K_{FLAT}$ correction coefficient derived in the shown routine is variable depending on not only the engine speed data N but also the intake air pressure PB.

At a step S92, the $K_{LRN}$ correction coefficient is derived on the basis of the engine speed data N and the basic fuel injection amount Tp. In order to enable this, a $K_{LRN}$ correction coefficients are set in a form of a two-dimensional look-up map in a memory address 126 in RAM 103. The $K_{LRN}$ correction coefficient derived at the step S92 is modified by adding a given value derived as a function of an average value of $K_\lambda$ correction coefficient for updating the content in the address of the memory block 126 corresponding to the instantaneous engine driving range at a step S93. In practice, updating value $K_{LRN(new)}$ of the $K_{LRN}$ correction coefficient is derived by the following equation:

$$K_{LRN(new)} = K_{LRN} + K_\lambda / M$$

where M is a given constant value.

Thereafter, the FALT flag is checked at a step S94. When the FALT flag is not set, process goes END. On the other hand, when the FALT flag is set as checked at the step S94, an error value $\Delta\lambda_{ALT}$ which represents an error from a reference air/fuel ratio ($\lambda = 1$) due to altitude variation, at a step S95. In the process done in the step S95, the error value $\Delta\lambda_{ALT}$ corresponds a product by multiplying the average value $\overline{K_\lambda}$ by the modified $K_{LRN}$ correction coefficient $K_{LRN(new)}$ and the $K_{ALT}$ correction coefficient.

At a step S96, an intake air flow rate data Q is derived by multiplying the basic fuel injection amount Tp by the engine speed data N. Then, based on the error value $\Delta\lambda_{ALT}$ derived at the step S95 and the intake air flow rate data Q derived at the step S96, an altitude indicative data $ALT_O$ is derived from a two-dimensional map stored in a memory block 127 of RAM 103.

Here, as will be appreciated, the error value $\Delta\lambda_{ALT}$ is increased according to increasing of altitude which cases decreasing of air density. On the other hand, the error value $\Delta\lambda_{ALT}$ decreases according to increasing of the intake air flow rate Q. Therefore, the variation of the altitude significantly influence for error value $\Delta\lambda_{ALT}$. Therefore, in practice, the assumed altitude $ALT_O$ to be derived in the step S97 increases according to decreasing of the intake air flow rate Q and according to increasing of the error value $\Delta\lambda_{ALT}$.

The assumed altitude data $ALT_O$ is stored in a shift register 128.

Figure 8:
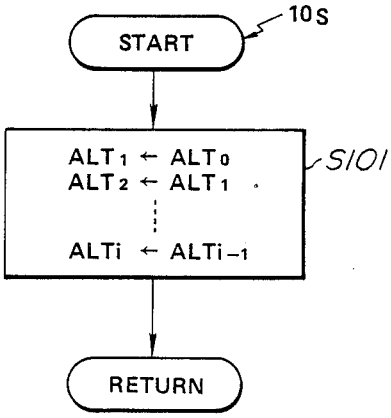
FIG. 8 is a flowchart of a routine for deriving an average assumed altitude.
Figure 9:
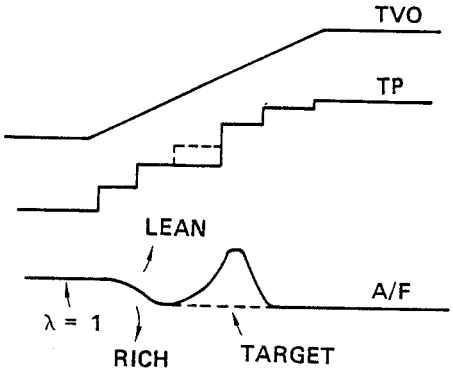
FIG. 9 is a chart showing relationship between an air/fuel ratio, basic fuel injection amount Tp and a throttle valve angle.

At a step S98, an average value $\overline{ALT}$ of the assumed altitude $ALT_O$ is derived over given number (i) of precedingly derived assumed altitude data $ALT_O$. For enabling this, the interrupt routine of FIG. 8 is performed at every given timing, e.g. every 10 sec. In the routine of FIG. 8, sorting of the stored assumed altitude data ALT is performed at a step S1O1. Namely, the shift register 128 is operated to sort the assumed altitude data ALT in order of derivation timing. Namely, most recent data is set as $ALT_1$ and the oldest data is set as $ALt_i$.

At the step S98, the average altitude data $\overline{ALT}$ is derived by the following equation:

$$\overline{ALT} = W_O \times ALT_O + W_1 \times ALT_1 \ldots W_i \times ALT_i$$

where $W_O$, $W_1 \ldots W_i$ are constant ($W_O > W_1 > \ldots > W_i; W_O + W_1 \ldots W_i = 1$)

Utilizing the intake air flow rate data Q derived at the step S96 and the average altitude data $\overline{ALT}$ derived at the step S98, the $K_{ALT}$ correction coefficient is derived, at a step S99. In the process of the step S99, map look-up against a two-dimensional map set in a memory block 129 in ROM 102 is performed in terms of the intake flow rate Q and the average altitude data $\overline{ALT}$.

Here, it will be noted that when the altitude is increased to case decreasing of the atmospheric pressure to reduce resistance for exhaust gas. Therefore, at higher altitude, induction volumetric efficiency is increased even at the same intake air pressure to that in the lower altitude. By this, the air/fuel mixture to be introduced into the engine cylinder becomes leaner. On the other hand, the exhaust pressure becomes smaller as decreasing the intake air flow rate and thus subject greater influence of variation of the atmospheric pressure. Therefore, the $K_{ALT}$ correction coefficient is set to be increased at higher rate as increasing of the average altitude data $\overline{ALT}$ and as decreasing the intake air flow rate Q.

In summary, a fuel injection amount in L-Jetronic type fuel injection is derived on the basis of the engine speed N and the intake air flow rate Q. As is well known, the basic fuel injection amout is derived by:

$$Tp = K_{cONL} \times Q/N$$

where $K_{CONL} = F/A\ (F/I\ gradient) \times 1/60 \times (number\ of\ cylinder)$ F/A: reciprocal of air/fuel ratio F/I gradient (ms/kg) = 1/(fuel flow rate per injection (l)$\times\rho$ $\rho$: specific gravity of fuel Here, the intake air flow rate Q can be illustrated by:

$$\begin{aligned} Q &= n = PV/RT \\ &= (Pn \times V_0 \times n_v \times N)/2R_m \times Tm \end{aligned}$$

where Pn=P $V = \frac{1}{2} V_{O \times nv} \times N$ $n_v$ is volumetric efficiency R=Rm (=29.27)

T=Tm

PV=nRT K M (equation of state of gas)

$V_O$: total exhaust gas amount $M^3$

Tm: absolute temperature of intake air T;

n: intake air weight K

R: constant of gas $M\ T^{-1}$

From the above equation, the equation for deriving Tp can be modified to:

$$Tp = K_{CONL} \times \{(N \times 60 \times V_O)/(2\ Rm \times Tm_{ref}) \times Pn \times n_v \times K_{TA}\}/N$$

where $1/Tm = K_{TA}/Tm_{ref}$ $Tm_{ref}$ is a reference temperature, e.g. 30° C.

$K_{TA}$ is a intake air temperature dependent correction coefficient which becomes 1 when the intake air temperature is reference temperature and increases according to lowering of the intake air temperature below the reference temperature and decreases according to rising of the intake air temperature above the reference temperature. Here, assuming $$K_{COND} = K_{CONL} \times (60 \times V_O)/(2\ Rm \times 303°\ K)$$

the equation for deriving Tp can be modified as follow:

$$K_{COND} = K_{CONL} \times (60 \times V_O)/(2\ Rm \times 303°\ K)$$

$$\begin{aligned} n_v &= \text{(intake air volume)/(cylinder volume)} \\ &= K_{PB} \times K_{FLAT} + K_{ALT} \end{aligned}$$

$$\begin{aligned} K_{ALT} &= \text{(intake air volume)/(reference intake air volume)} \\ &= (Vro - Vr')/(Vro - Vr'_{ref}) \\ &= \{Vro \times (1 - Vr'/Vro)\}/\{Vro \times (1 - Vr'_{ref}/Vro)\} \end{aligned}$$

where Vro is BDC (bottom dead center) cylinder volume;

Vr' is BDC remaining exhaust gas volume; and $Vr'_{ref}$ is standard remained exhaust gas volume $= \{1 - 1/E \times (Vr'/Vr)\}/\{1 - 1/E \times (Vr'_{ref}/Vr)\}$ Vr is TDC (top dead center) cylinder volume $$\begin{aligned} Vr &= 1/E \times Vro \\ &= \{1 - 1/E \times (Pr/PB)\}/\{1 - 1/E \times (Pr_{ref}/PB)\} \end{aligned}$$

$$Vr'/Vr = (Pr/PB)^{1/K}$$

E: compression ratio;

K: relative temperature;

Pr: exhaust gas pressure (abs)

As will be appreciated herefrom, by employing the $K_{ALT}$ correction coefficient, error in $\lambda$ control, altitude dependent error versus of the intake air pressure in deceleration or in acceleration at a certain altitude versus that in the standart altitude, can be satisfactorily compensated without requiring an exhaust pressure sensor and atmospheric pressure sensor.

Figure 13:
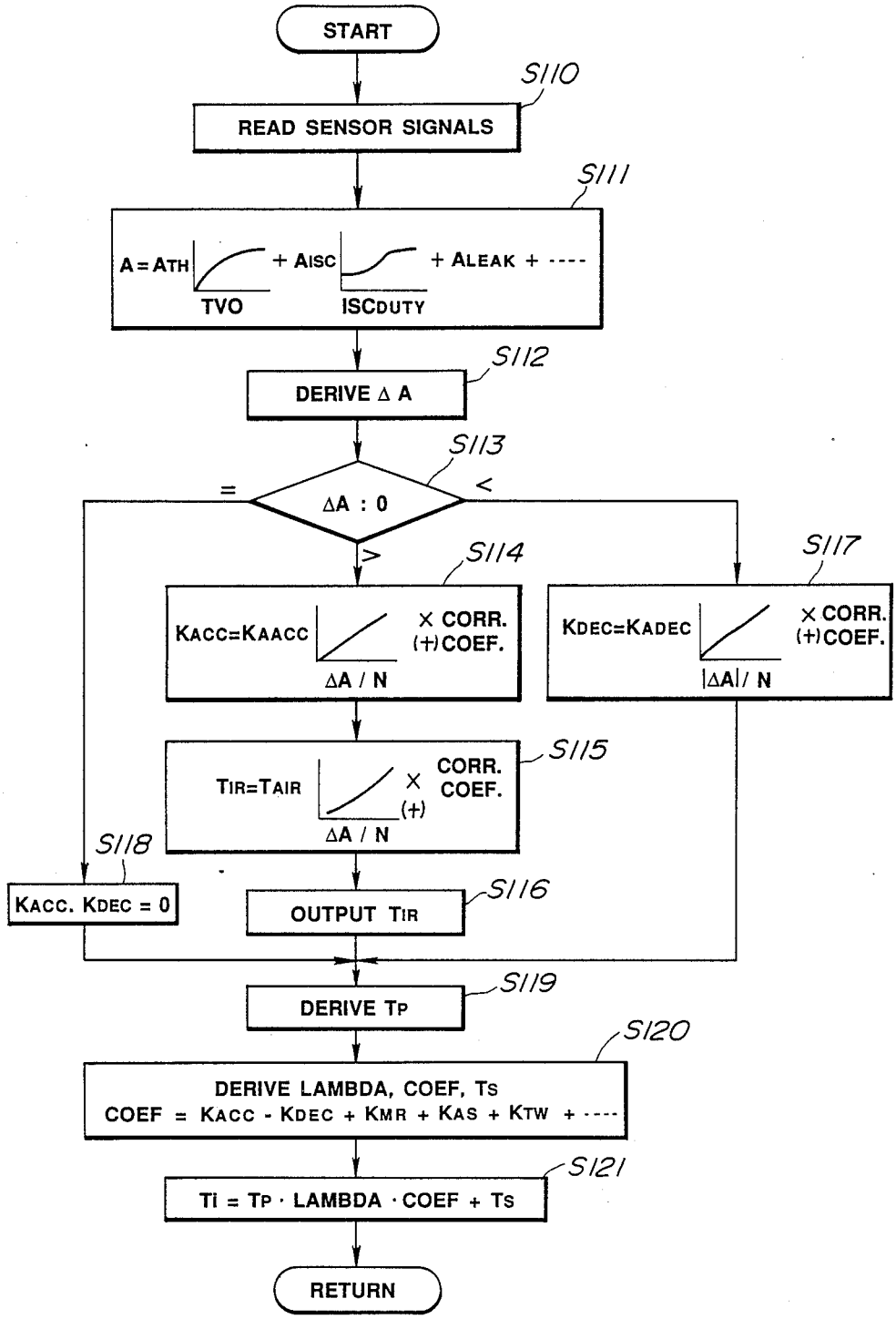
FIG. 13 is a flow chart showing another embodiment of a fuel injection amount derivation routine to be executed in place of the routine of FIGS. 4(*a*), 4(*b*) and 4(*c*).

FIG. 13 shows a modified routine for deriving the fuel injection amount Ti. In the shown routine, fuel injection amount is increased and decreased with a fuel injection amount correction value dervied on the basis of intake air path area variation speed.

Similarly to the former embodiment, various sensor signals, relevant engine driving condition indicative data, such as the engine speed data N, intake air pressure data PB and so forth, at a step S110. Thereafter, at a step S111, an air intake path area A is derived on the basis of the throttle valve angular position represented by the throttle angle indicative signal TVO and the auxiliary air control pulse width $ISC_{DY}$. Similarlt to the routine shown in FIGS. 4(*a*) to 4(*c*), the intake air flow path area $A_{TH}$ is derived through map look up by looking a primary path area map set in a memory block 130 in ROM 103 in terms of the throttle valve angular position TVO. Similarly, the auxiliary intake air flow path area $A_{ISC}$ is derived through map look-up by looking up an auxiliary air flow path map set in a memory block 131 of ROM 103 in terms of the duty cycle $ISC_{DY}$ of the auxiliary air control pulse. Therefore, the intake air path area A can be practically derived by the following equaition:

$$A = A_{th} + A_{ISC} + A_{LEAK}$$

At a step S112, a variation ratio $\Delta A$ of the intake air path area A in a unit time, e.g. within an interval of execution cycles, is derived. The derived intake air path area variation ratio $\Delta A$ is checked at the step S113. When the intake air path area variation ratio $\Delta A$ is greater than zero, an enrichment correction coefficient $K_{RICH}$ is derived at a step S114. Practically, an acceleration enrihment correction value $K_{ACC}$ is derived on the basis of $\Delta A/N$ which represents intake air path area variation ratio per engine revolution cycle. Derivation process of the acceleration enrichment value $K_{ACC}$ is performed by looking-up the map set in a memory block (not shown) in ROM 103. At the step S114, the enrichment correction coefficient $K_{RICH}$ is derived by:

$$K_{RICH}=K_{ACC}\times A_{ACC}$$

where $A_{ACC}$ is an enrichment correction value derived based on variaous enrichment demand indicative engine parameter, such as an engine coolant temperature Tw and so forth.

At a step S115, a fuel injection amount $T_{IR}$ for an acceleration demand responsive asynchronous fuel injection is derived on the basis of $\Delta A/N$ and various correction coefficients. The basic asynchronous fuel injection amount $TA_{IR}$ is derived by map look-up performed against a map set in ROM 103 in terms of $\Delta A/N$. By multiplying the derived basic asynchronous fuel injection amount $TA_{IR}$ by the correction coefficients, the asynchronous fuel injection amount $T_{IR}$ is derived. Subsequently, derived fuel injection amount $T_{IR}$ is output at step S116. Therefore, fuel injection for the amount $T_{IR}$ is performed irrespective of the engine revolution cycle for temporary enrichment.

On the other hand, when the intake air path area variation ratio $\Delta A$ as checked at the step S113, fuel decreasing correction coefficient $K_{LEAN}$ is derived at a step S117. The fuel decreasing correction coefficient $K_{LEAN}$ is composed of a deceleration demand dependent component $KA_{DEC}$ derived on the basis of $|\Delta A|/N$ and other correction coefficients. In practice, the fuel decreasing correction coefficient $K_{LEAN}$ is derived by multiplying the deceleration demand dependent component $KA_{DEC}$ by other correction coefficient.

When the intake air path area variation ratio $\Delta A$ is zero as checked at the step S113, the enrichment correction coefficient $K_{RICH}$ and the fuel decreasing correction coefficient $K_{LEAN}$ are both set to zero at a step S118.

After one of the step S116, S117 and S118, basic fuel injection amount Tp is derived substantially the same manner as that performed at the step S24 in the former embodiment, at a step S119. Then, correction values, such as $K_{\Delta}$, $K_{LRN}$, COEF, Ts and so forth are derived or read out at a step S120. In this shown routine, the correction coefficient COEF is derived by the following equaition:

$$COEF=K_{RiCH}-K_{LEAN}+K_{MR}+K_{AS}+K_{AS}+K_{TW}\ldots$$

where $K_{MR}$ is a mixture ratio dependent correction coefficient $K_{AS}$ is an engine start-up enrichment correction coefficient $K_{Tw}$ is an engine coolant temperature dependent correction coefficient.

Based on the basic fuel injection amount Tp derived at the step S119 and correction coefficient and correction value derived at the step S120, the fuel injection amount Ti is derived at a step S121.

According to this embodiment, the fuel injection control characteristics at the engine transition condition can be significantly improved by introducing the factor of the intake air path area variation. Therefore, precise emission control becomes possible to minimize polutant, such as $NO_x$, HC, CO, in the exhaust gas. Furthermore, by this, imcomplete combustion in the vicinity of the spark plug, after burning, hesitation, acceleration shock, shift shock in an automatic transmission can be successfully eliminated.

Furthermore, since the shown embodiment of the fuel supply control system derives the basic fuel injection amount by multiplying the intake air pressure PB by the induction volumetric efficiency $Q_{CYL}$, modifying the product with intake air temperature dependent correction coefficient $K_{TA}$, and multiplying the modified product by the constant $K_{CON}$, the resultant value as the basic fuel injection amount can be satisfactorily precise.

It should be appreciate that the invention is applicable not only the specific construction of the fuel injection control system but also for any other constructions of the fuel injection systems. For example, the invention may be applicable for the control systems set out in the co-pending U.S. patent application Ser. Nos. 171,022 and 197,843, respectively filed on Mar. 18, 1988 and May 24, 1988, now U.S. Pat. Nos. 4,911,129 and 4,889,099, which have been assigned to the common assignee to the present invention. The disclosure of the above-identified two U.S. patent applications are herein incorporated by reference for the sake of disclosure.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention in the appended claims.

What is claimed is:

1. A control system for an internal combustion engine, comprising:

means for monitoring engine driving condition representative parameters including an engine speed representative parameter, an engine load representative parameter and an intake air flow path area representative parameter;

means for monitoring an engine revolution cycle to produce engine position data representative of stroke positions of respective engine cylinders;

means, periodically operated at a known time, for deriving intake air flow path area variation data on the basis of said intake air flow path area representative parameter;

means for deriving time difference data between a time of derivation of said intake air flow path variation data and an open time of intake valves of respective engine cylinders on the basis of said engine position data and said known time;

means for deriving a basic fuel demand for each engine cylinder at an open time of an associated intake valve on the basis of said engine speed representative data, said engine load representative data, said intake air flow path area variation data and said time difference data; and means for controlling engine operation on the basis of said basic fuel demand.

2. An engine control system as set forth in claim 1, wherein said controlling means derives a fuel supply amount for each engine cylinder on the basis of said basic fuel demand and controls a fuel supply system associated with said internal combustion engine for supplying the said derived fuel supply amount.

3. An engine control system as set forth in claim 1, wherein said controlling means derives spark ignition timing for said internal combustion engine on the basis of said basic fuel demand and said engine speed data.

4. An engine control system as set forth in claim 1, wherein said controlling means performs an air/fuel ratio control on the basis of said basic fuel demand.

5. An engine control system as set forth in claim 2, wherein said controlling means also derives spark ignition timing for said internal combustion engine on the basis of said basic fuel demand and said engine speed data.

6. An engine control system as set forth in claim 2, wherein said controlling means also performs an air/fuel ratio control on the basis of said basic fuel demand.

7. An engine control system as set forth in claim 1, which further comprises means for deriving a basic fuel supply amount on the basis of said engine speed representative data and said engine load representative data, and said basic fuel demand derivation means derives a correction value for said basic fuel supply amount on the basis of said engine speed representative data, said intake air flow path area variation data and said time difference data and corrects said basic fuel supply amount by said correction value for deriving said basic fuel demand for each engine cylinder.

8. A control system for an internal combustion engine, comprising:

means for monitoring engine driving condition representative parameters including an engine speed representative parameter, an engine load representative parameter and an intake air flow path area representative parameter;

means for monitoring an engine revolution cycle to produce engine position data representative of stroke positions of respective engine cylinders;

means, periodically operated at a known time, for deriving intake air flow path area variation data on the basis of said intake air flow path area representative parameter;

means for deriving time difference data between a time of derivation of said intake air flow path variation data and an open time of intake valves of respective engine cylinders on the basis of said engine position data and said known time;

means for deriving assumed engine load data for each engine cylinder at an open time of the associated intake valve on the basis of said engine speed representative data, said engine load representative data, said intake air flow path area variation data and said time difference data; and means for controlling engine operation on the basis of said engine speed representative data and said assumed engine load data.

9. An engine control system as set forth in claim 8, wherein said controlling means derives a fuel supply amount for said each engine cylinder on the basis of said engine speed data and said assumed engine load data.

10. An engine control system as set forth in claim 9, wherein said controlling means also derives spark ignition timing for said internal combustion engine on the basis of a basic fuel supply amount calculated on the basis of said engine speed representative data and said assumed engine load data.

11. An engine control system as set forth in claim 9, wherein said controlling means also performs an air/fuel ratio control on the basis of a basic fuel supply amount calculated on the basis of said engine speed representative data and said assumed engine load data.

12. A control system for an internal combustion engine, comprising:

means for monitoring engine driving condition representative parameters including an engine speed representative parameter, an engine load representative parameter and an intake air flow path area representative parameter;

means for deriving a basic fuel supply amount on the basis of said engine speed representative parameter and said engine load representative parameter;

means for deriving intake air flow path area variation data on the basis of said intake air flow path area representative parameter;

means for discriminating an engine operating condition on the basis of said intake air flow path variation data for deriving a correction value for said basic fuel supply amount on the basis of said engine speed representative parameter and said intake air flow path area variation data for increasing and decreasing fuel supply amount depending on the gradient of engine load variation detected from said intake air flow path area variation data; and means for correcting said basic fuel supply amount with said correction value for controlling fuel supply to said engine based thereon.

13. An engine control system as set forth in claim 12, wherein said controlling means detects an engine acceleration demand based on said intake air flow path area variation data for deriving a temporary fuel supply amount on the basis of said intake air flow path area variation data and said engine speed representative parameter and performs fuel supply irrespective of an engine revolution cycle.

* * * * *